US005224320A

United States Patent [19]

Mai

[11] Patent Number: 5,224,320

[45] Date of Patent: Jul. 6, 1993

[54] SPACE FRAME SYSTEM

[76] Inventor: Paul K. Mai, 3308 S. Holmes Rd., Salina, Kans. 67401

[21] Appl. No.: 951,161

[22] Filed: Sep. 25, 1992

[51] Int. Cl.[5] ..... E04H 12/00

[52] U.S. Cl. ..... 52/648.1; 52/81.3; 403/171; 403/176; 403/400

[58] Field of Search ..... 52/648.1, 637, 695, 52/649.8, 677, 650.02, 651.01, 651.06, 655.1, 656.9, 668, 81, 713; 403/400, 391, 396, 171, 176, 174

[56] References Cited

U.S. PATENT DOCUMENTS

| | | | |
|---|---|---|---|
| 548,165 | 10/1895 | Lavender . | |
| 2,879,087 | 3/1959 | Haglund . | |
| 3,186,522 | 6/1965 | McCauley | 52/81 X |
| 3,360,883 | 1/1968 | Glanzer . | |
| 3,494,578 | 2/1970 | Cureton | 52/81 X |
| 3,563,580 | 2/1971 | Black | 52/655.1 X |
| 3,844,074 | 10/1974 | Ahorn | 52/81 |
| 3,877,874 | 4/1975 | Jury | 52/81 X |
| 3,966,337 | 6/1976 | Crawford . | |
| 4,145,149 | 3/1979 | Ruga | 52/81 X |
| 4,171,838 | 10/1979 | Grundy . | |
| 4,213,640 | 7/1980 | Miles . | |
| 4,247,218 | 1/1981 | Jeannin | 52/81 X |
| 4,371,281 | 2/1983 | Magner | 403/374 |
| 4,437,288 | 3/1984 | Foissac et al. . | |
| 4,470,238 | 9/1984 | Maistre . | |
| 4,562,681 | 1/1986 | Smith | 52/637 X |
| 4,566,818 | 1/1986 | Schwartz et al. | 52/81 X |
| 4,569,165 | 2/1986 | Baker et al. | 52/81 |
| 4,677,805 | 7/1987 | Schleisner . | |

FOREIGN PATENT DOCUMENTS

| | | |
|---|---|---|
| 530341 | 12/1940 | United Kingdom . |
| 633641 | 8/1936 | Fed. Rep. of Germany . |
| 2904330 | 8/1979 | Fed. Rep. of Germany . |
| 1012892 | 7/1952 | France . |
| 1064552 | 5/1954 | France . |
| 346812 | 3/1937 | Italy . |

OTHER PUBLICATIONS

"The Design and Construction of Double-layer Space Frame Grids", H. B. Walker, pp. 289-302, Drawing of prior connector by inventor.

*Primary Examiner*—Carl D. Friedman
*Assistant Examiner*—Creighton Smith
*Attorney, Agent, or Firm*—Michael Yakimo, Jr.; D. A. N. Chase; Richard P. Stitt

[57] ABSTRACT

A joint connector for a space frame comprises two pairs of opposed brackets having seats for the transverse chords of the grid. Upon securing the brackets one to the other a housing encompasses the intersection of the transverse chords therein. An aperture chord mounting flange extends from each corner and towards the opposing grid of the space frame. Each diagonal chord extending between the upper and lower grids has an aperture mounting plate welded thereto. Upon alignment of apertures between the mounting plate and chord mounting flange, bolt/nut combinations secure one to the other. An alternative embodiment presents a brake/spacer plate to preclude the diagonal chord from being positioned away from a desired extension away from the joint connector. The joint connectors allow the transverse and diagonal chords of the space frame to be secured off-site and/or in a ground-adjacent position which reduces the fabrication assembly and erection costs.

22 Claims, 4 Drawing Sheets

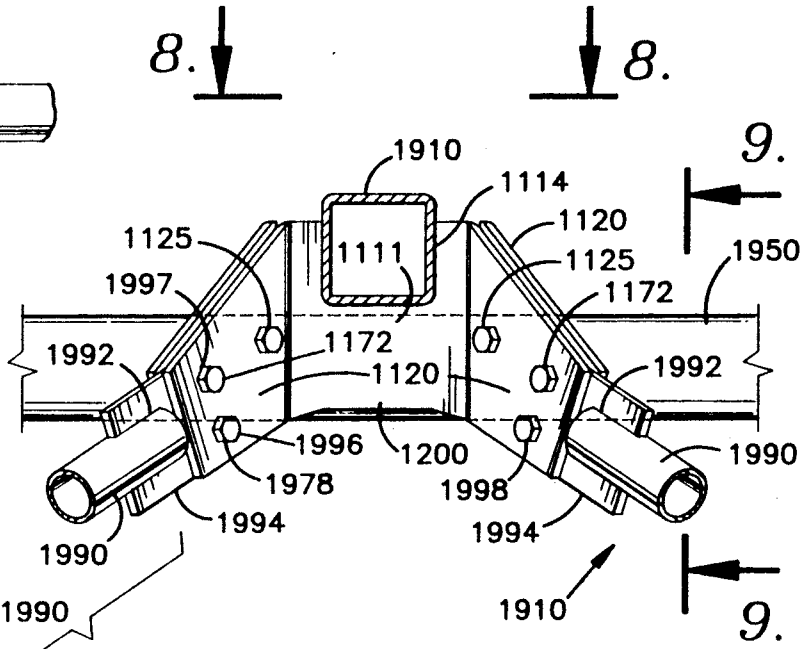
Fig. 7.
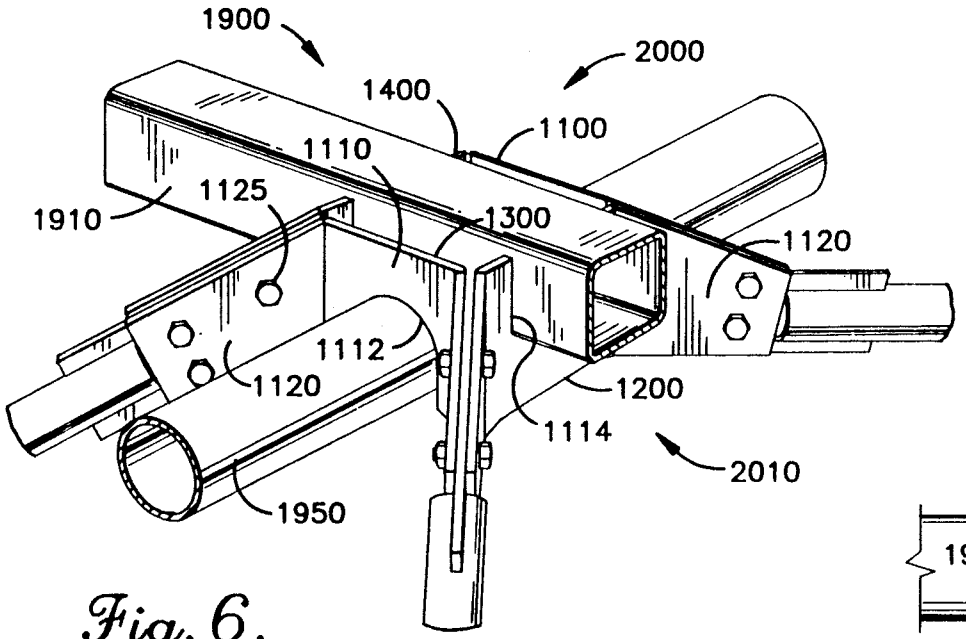
Fig. 6.
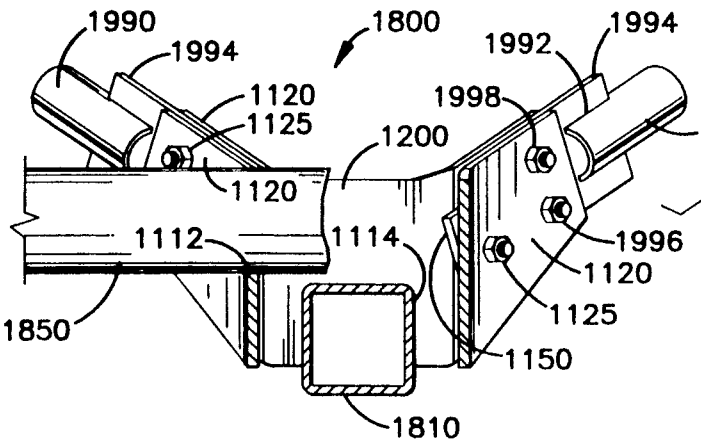

SPACE FRAME SYSTEM

BACKGROUND OF THE INVENTION

This invention is generally directed to apparatus for use at junctures of chords of a space frame grid, and more particularly, to a joint connector for use in a space frame system.

The use of space frame grids, particularly in large buildings, is known. Such space frame grids have been found to be cost effective in large buildings having supports widely spaced and few in number. Space frame grids can also be used when the mechanical services, vent ducts and gas and water pipes need be in the roof.

The basic geometry of the space frame presents an upper grid comprising an upper layer of support pipes/-chords and a lower layer of the same. The upper and lower layers of pipes are at right angles one to the other. The lower grid presents a similar pipe/chord arrangement. A plurality of joint connectors secure the intersection of the layers of the support pipes in the upper and lower grids. Diagonal struts or chords then extend between the joint connectors of the upper and lower grids. The relative upper and lower grid arrangements can be of various relative displacements such as square-on-square offset, square-on-square offset diagonally, square-on-larger-square, etc.

The chosen relative grid arrangement will depend on various criteria including the manner of grid support, the type of loads placed thereon, the desired force patterns on the grid arrangement and aesthetic desires.

Steel pipes are commonly used in the construction of space frame grids, the thickness of which depends on the desired load characteristics. It is recognized that the jointing of the pipes in and between the grids is a major problem in the construction of space frames. In some cases it may be necessary to construct the various grid arrangements on site which can be relatively expensive. Thus, it is recognized that it is cost-effective to do as much fabrication of the space frame in the workshop and on the ground as possible. It thus is most desirable to assemble the grids and interconnect the same prior to lifting the assembled space frame into its functional position by a crane or the like.

Thus, it is desirable to have joint connectors which allow for such a cost-effective assembly. Each joint connector should secure the intersection of the upper and lower support pipes of each grid while providing structure to extend support chords between the upper and lower grids.

Problems can arise in the connection of the diagonal chord between these upper and lower grids if the forces acting along the diagonal chords are directed to points outside the center of the joint connector and/or the intersecting chords. If so, eccentric forces will arise which can lead to a degradation in the loading capacity and/or quality of the space frame.

In response thereto I have invented a joint connector which provides means to secure in the shop the intersection of the transverse chords of the upper and lower frames and connect such frames. My joint connectors present a plurality of upwardly and/or downwardly extending chord mounting flanges at the four corners of each connector. In turn, diagonally extending chords are connected between each flange so as to provide the desired chord relationship between the upper and lower grids. A second embodiment of the joint connector is utilized which provides a spacer/brake plate between the mounting flanges. This plate precludes the diagonally extending chords from being displaced beyond a desired relationship between the upper and lower grids. The joint connectors are easily connected to the intersection of the transverse pipes of each grid as well as to the diagonally extending chords in a manner which allows for a significant amount of off-site and/or on-ground construction. My joint connectors allow for the forces acting along the diagonal chords to be directed through the center thereof so as to delimit and control any asymmetric forces. As such, the connectors allow for cost-effective construction of space frame systems.

It is therefor a general object of this invention to provide a joint connector for utilization in space frame systems.

Another object of this invention is to provide a joint connector, as aforesaid, which can be easily used for off-site and/or on-ground construction of space frame systems.

A further object of this invention is to provide a joint connector, as aforesaid, which utilizes a plurality of chord mounting flanges or plates extending towards the opposed upper or lower grid of the space frame system.

Another object of this invention is to provide a joint connector, as aforesaid, which is easily shop welded to the intersection of the transverse pipes of the upper or lower grids.

Still a further object of this invention is to provide a joint connector, as aforesaid, which easily connects and maintains the diagonal chords in a desired extension between the upper and lower grids of the space frame system.

Another object of this invention is to provide a joint connector, as aforesaid, which directs the lines of force acting along the diagonal chords through the center of the joint connector.

A still further object of this invention is to present a joint connector, as aforesaid, in which on-site connections are made by bolts or the like.

Another object of this invention is to provide a joint connector, as aforesaid, which provides a structural connection between transversely extending pipes of a space frame grid.

Still another object of this invention is to provide a joint connector, as aforesaid, which provides means for structurally connecting the diagonal chords of a space frame system.

Another object of this invention is to provide a joint connector, as aforesaid, which allows for the forces thereon to be directed to a common point so as to eliminate or control any eccentric connection problems.

A further object of this invention is to provide a joint connector, as aforesaid, which comprises a plurality of brackets allowing for economical and easy assembly and use.

A still further object of this invention is to provide a joint connector, as aforesaid, which has a configuration providing for each connection thereof to be leveled upon assembly.

Other objects and advantages of this invention will become apparent from the following description taken in connection with the accompanying drawings, wherein is set forth by way of illustration and example, first and second embodiments of this invention.

BRIEF DESCRIPTION OF THE DRAWINGS

FIG. 6 is a perspective view of an alternative joint connector secured to the intersection of transverse pipes of the upper grid of a space frame system;

FIG. 7 is a front plan view showing the relationship between upper and lower joint connectors of the upper and lower grids of a space frame with a foreshortened diagonal chord extending between chord mounting flanges of each connector;

DESCRIPTION OF THE PREFERRED EMBODIMENT

Figures 1, 2:
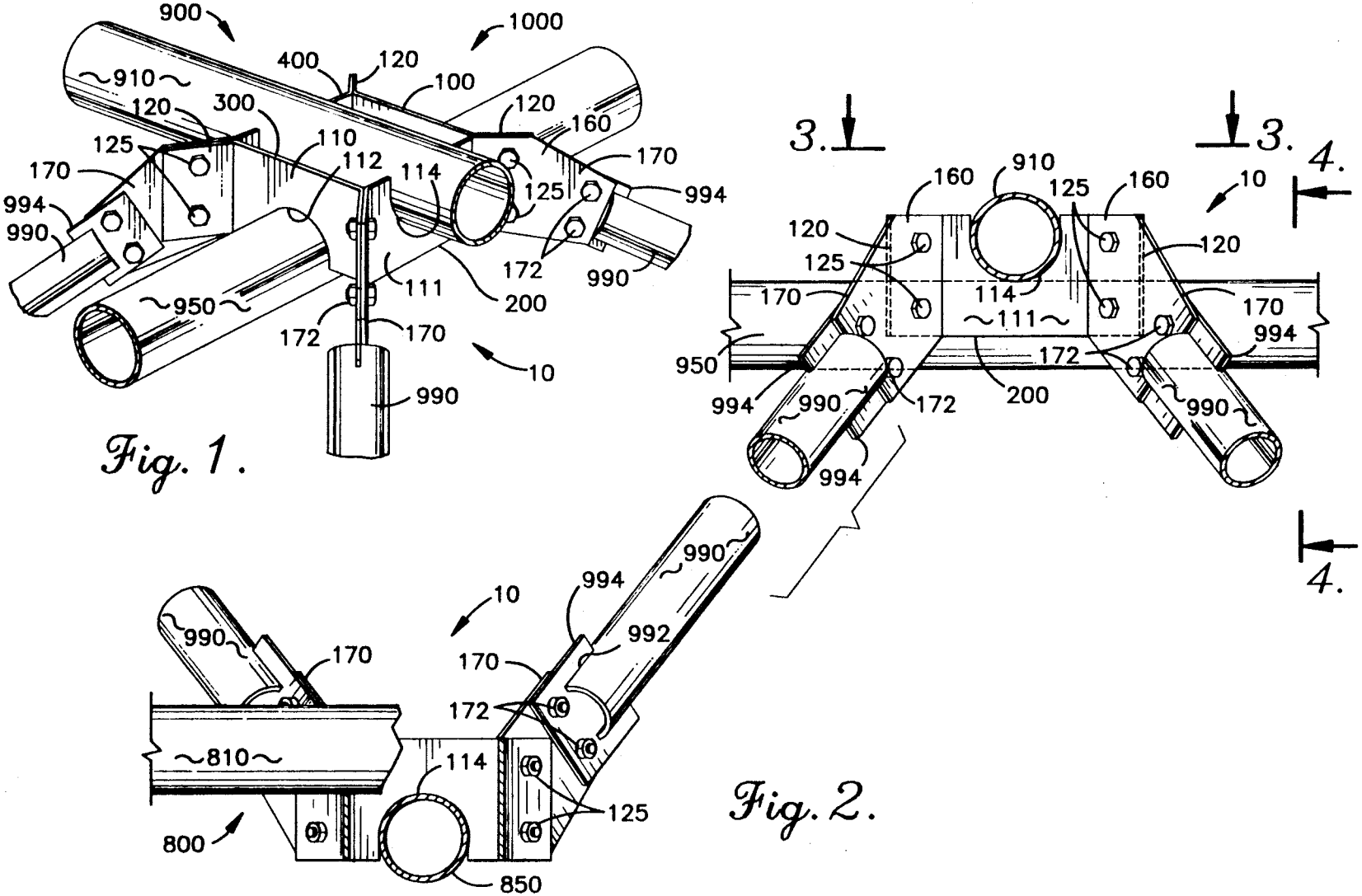
FIG. 1 is a perspective view of one joint connector secured to the intersection of transverse pipes of the upper grid of a space frame system.
FIG. 2 is a front plan view showing the relationship between upper and lower joint connectors of the upper and lower grids of a space frame with a foreshortened diagonal chord extending between chord mounting flanges of each connector.
Figure 5:
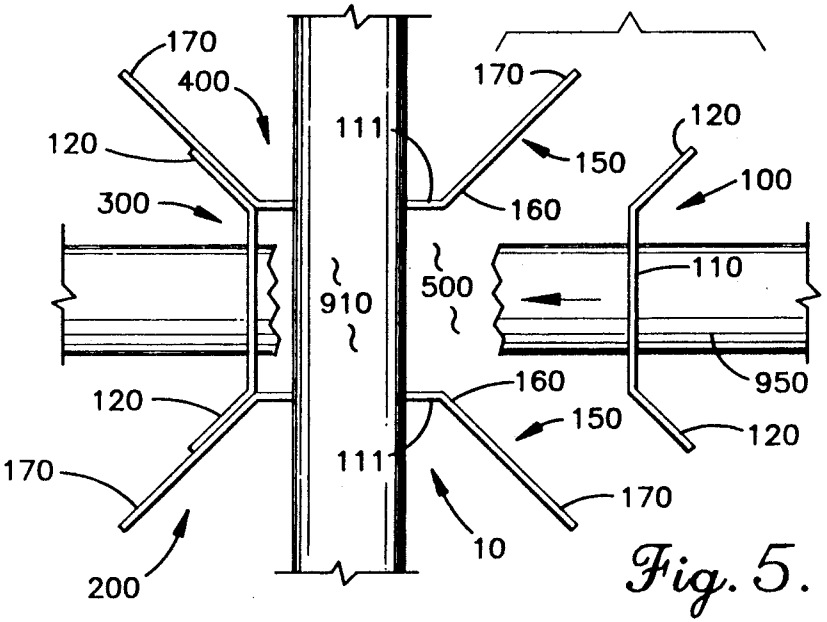
FIG. 5 is a diagrammatic view showing one of the connector brackets and pipe connected thereto exploded from the connector proper.
Figure 4:
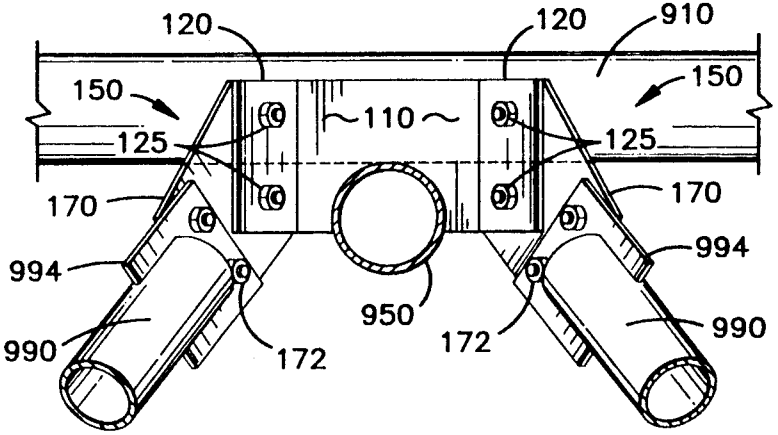
FIG. 4 is an elevation view, taken along lines 4—4 in FIG. 2, illustrating the connection of two diagonal chords to the respective chord mounting flanges.
Figure 3:
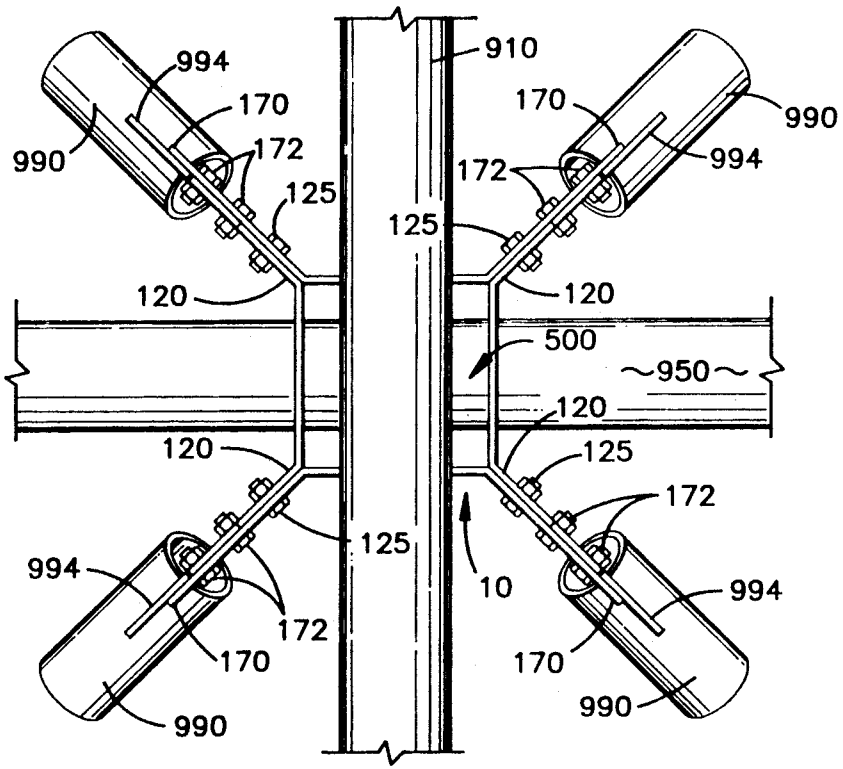
FIG. 3 is top plan view, taken along lines 3—3 in FIG. 2, showing diagonal chords downwardly extending from each chord mounting flange of the FIG. 1 connector.
Figure 10:
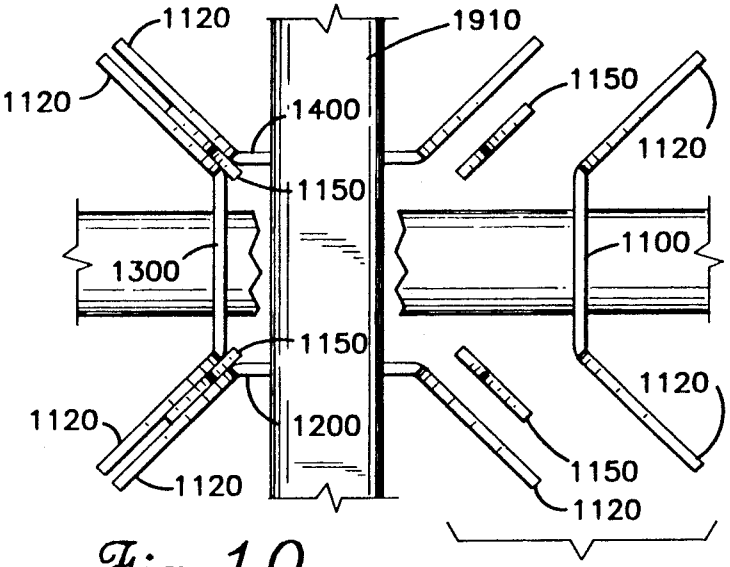
FIG. 10 is a diagrammatic view showing one of the connector brackets, pipe and brake plates exploded from the connector proper.
Figure 9:
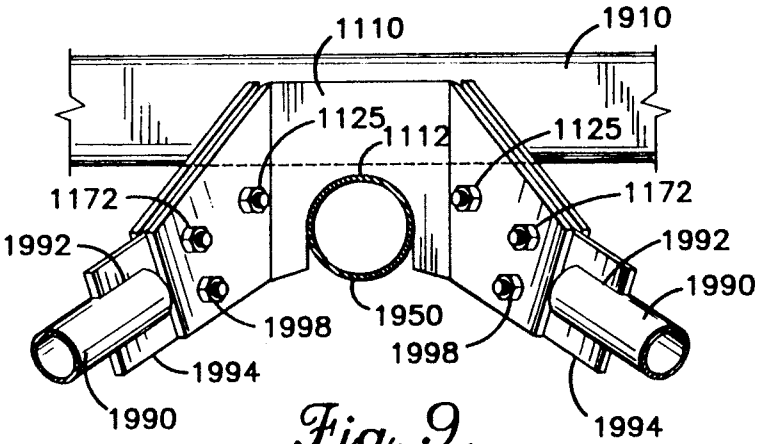
FIG. 9 is an elevation view of the joint connector taken along lines 9—9 in FIG. 7.

Turning more particularly to the drawings, FIG. 1 shows a basic joint connector 10 as utilized in a portion of an upper grid 900 of a space frame system 1000. As such FIG. 1 shows a transverse relationship/intersection of one chord/pipe 910 of the upper layer of pipes and one chord/pipe 950 of the lower layer of pipes of the upper grid 900. It is understood that the grid 900 comprises a plurality of intersections of transverse upper 910 and lower 950 chords.

As illustrated, each connector 10 comprises four brackets 100, 200, 300, 400 which are fastened together to present a square housing with a central opening 500 therein. Each bracket 100, 300 of the first pair of opposed brackets comprises a planar web 110 having at each end a canted bracket mounting flange 120. Each bracket of the second pair of opposed brackets 200, 400 comprises a planar web 111 with an elongated, canted chord mounting flange 150 extending from each end thereof. Each chord mounting flange 150 comprises a bracket mounting section 160 and a chord mounting section 170. As shown, the bracket mounting section 160 is generally similar in configuration to the bracket mounting flange 120. The chord mounting section 170 extends from the bracket mounting section 160 and is canted relative thereto.

Web 110 of brackets 100, 300 has a semi-circular recess 112 or notch which presents a seat for a portion of a chord 950. As shown in FIG. 1, the seats 112 extend downwardly for reception of a portion of a lower chord 950 of the upper grid 900 therein. Such a recess 112 will extend upwardly when brackets 100, 300 are used to support an upper pipe 810 of the lower grid 800.

Web 111 of brackets 200, 400 has a semi-circular recess 114 or notch which presents a seat for a portion of chord 910. As shown in FIG. 1, each seat 114 upwardly extends for the reception of an upper chord 910 of the upper grid 900 therein. Such a recess 114 will extend downwardly when brackets 200, 400 are used to receive a portion of the lower pipe 850 of the lower grid 800 therein.

The space frame 1000 requires an assembly of a plurality of elongated transverse pipes 910, 950 of the upper grid 900 and pipes 810, 850 of lower grid 800. The upper 900 and lower 800 grids are then connected with diagonal chords 990. The bracket pairs 100, 300 and 200, 400 are welded about the intersections of pipes 910, 950, 810, 850. As shown in FIG. 1, the pair of brackets 100, 300 are welded on the lower pipe 950 such that a portion of the pipe 950 is seated within overlying notches 112. The pair of brackets 200, 400 are welded on the upper pipe 910 such that a portion of the pipe 910 is seated within underlying notches 114. Upon the respective webs 110, 111 of each bracket forming a square, the bracket mounting flanges 120 of brackets 100, 300 are positioned adjacent the bracket mounting sections 160 of each chord mounting flange 150. Bolt/nut combinations 125 are inserted through aligned apertures in each mounting flange 120 and adjacent mounting section 160 and appropriately tightened. Upon tightening, the webs 110, 111 of brackets 100, 200, 300, 400 present a four-cornered housing surrounding a central open area 500. The intersection of chords 910, 950 is maintained within this central area 500. It is understood that the welding may occur after the tightening of the bolt/nut combinations if so desired. As shown in FIG. 1, a chord mounting section 170 of each bracket 200, 400 downwardly extends from each corner of the housing and towards the lower grid 800. Such a joint connection is made at each intersection of pipes 910, 950.

As best shown in FIG. 2, the brackets 100, 300 are welded on the upper pipe 810 of grid 800 such that a portion of the pipe 810 is seated within the aligned, upwardly extending notches 112 The pair of brackets 200, 400 are placed on the lower pipe 850 such that a portion of the pipe 850 is seated within downwardly extending notches 114. Upon the respective webs of each bracket forming a square, the bracket mounting flanges 120 of brackets 100, 300 are adjacent the bracket mounting plates 160 of each chord mounting flange 150. Bolt/nut combinations 125 are inserted through aligned apertures in each flange 120 and adjacent plate 160 and appropriately tightened. Upon tightening, the webs 110, 111 of brackets 100, 200, 300, 400 present a four-cornered housing surrounding a central open area 500. The intersection of chords 810, 850 occurs within this central area 500. It is understood that the welding may occur after the tightening of the bolt/nut combinations if so desired. As shown in FIG. 2, a chord mounting section 170 of each bracket 200, 400 upwardly extends from each corner of the housing and towards the upper grip 900.

Thus, it can be appreciated that the brackets 100, 200, 300, 400 upon reversal may be used with either grid 800, 900.

As previously discussed, various spatial relationships between the upper 900 and lower 800 grids may be utilized in a space frame system 1000. For purposes of illustration and not limitation the use of a square-on-square offset is discussed. Thus, the intersection of the pipes 910, 950 of the upper grid with accompanying connector 10 will be vertically displaced from the center of a square resulting from the intersection of the plurality pipes 810, 850 of the lower grid. Accordingly, it is desired to connect a diagonal chord 990 between a central joint connector 10 on the upper grid 900 and a joint connector 10 found at each corner of the underlying square of the lower grid 800.

FIG. 2 shows the connection of a diagonal chord 990 from a corner of an upper grid 900 joint connector 10 to a corner of the lower grid 800 joint connector 10 as found at a corner of the underlying square. As shown, each chord 990 connection is provided by cutting slots 992 at the opposed ends of each diagonal chord 990 and welding a planar plate 994 therein. Apertures in each plate 994 are aligned with apertures in the adjacent chord mounting section 170. Upon a desired chord 990 extension, bolt/nut combinations 172 are tightened to secure the plate 994 and the attached diagonal chord 990 to the adjacent chord mounting section 170. This connection is done for each diagonal chord 990 extending from each housing corner such that four diagonal chords 990 downwardly extend from an upper connector 10. Likewise the opposed ends of each chord 990 present a planar plate 994 which are likewise secured to a mounting section 170 upwardly extending from a corner on a lower connector 10 found at each corner of the underlying square. Such connections are made throughout the entire space frame 1000. It is understood that not all joint connectors may have four diagonal chords 990 extending therefrom, e.g. those connectors adjacent the perimeter of the frame system.

Electrical, mechanical, insulation and roofing may then be installed on the frame 1000 at this time. Upon completion the ground adjacent space frame system 1000 may be lifted into place by a crane or the like upon the vertical building support members.

FIGS. 6–11 show an alternative joint connector 2010 as utilized in a portion of an upper grid 1900 of a space frame system 2000. FIG. 6 shows a transverse relationship/intersection of one chord/pipe 1910 of the upper layer of pipes and one chord/pipe 1950 of the lower layer of pipes of the upper grid 1900. It is understood that the grid 1900 comprises a plurality of intersections of transverse upper 1910 and lower 1950 chords.

As illustrated, each connector 2010 comprises four brackets 1100, 1200, 1300, 1400 which upon fastening present a square housing with a central opening 1500 therein. Each bracket comprises a planar web 1110 or 1111 having at each end a canted mounting flange 1120.

Web 1110 of brackets 1100, 1300 has a semi-circular recess 1112 or notch which presents a downwardly depending seat for a portion of a circular pipe/chord 1950. Web 1111 of brackets 1200, 1400 has a recess 1114 or notch which presents a seat 1114 for a portion of the square chord 1910. As shown in FIG. 6, each seat 1114 upwardly extends for the reception of an upper square chord 1910 of the upper grid 1900 therein. Such a recess 1114 will extend downwardly when brackets 1200, 1400 are used to receive a portion of the lower pipe 1818 of the lower grid 1800 therein. Recess 1112 will extend upwardly to receive a portion of the upper pipe 1850 of the lower grid 1800 therein.

As above described, the space frame 2000 requires an assembly of a plurality of elongated transverse pipes 1910, 1950 of the upper grid 1900 and pipes 1810, 1850 of lower grid 1800. The upper 1900 and lower 1800 grids are then connected with diagonal chords 1990. The bracket pairs 1100, 1300 and 1200, 1400 are welded about the intersections of pipes 1910, 1950, 1810, 1850. As shown in FIG. 6, the pair of brackets 1100, 1300 are welded on the lower pipe 1950 such that a portion of the pipe 1950 is seated within overlying notches 1112. The pair of brackets 1200, 1400 are welded on the upper pipe 1910 such that a portion of the pipe 1910 is seated within underlying seats 1114. Upon the respective webs 1110, 1111 of each bracket forming a square, the bracket mounting flanges 1120 of each bracket are positioned adjacent each other.

Inserted between each flange 1120 are brake/spacer plates 1150. The bolts of bolt/nut combinations 1125 are inserted through the rear aligned apertures in each mounting flange 1120 and through the brake plate 1150 and appropriately tightened. Upon tightening, the webs 1110, 1111 of brackets 1100, 1200, 1300, 1400 present a four-cornered housing surrounding a central open area 1500. The intersection of chords 1910, 1950 is maintained within this central area 1500. It is understood that the welding may occur after the tightening of the bolt/nut combinations if so desired. As shown in FIG. 7, the mounting flanges 1120 of each bracket downwardly extend from each corner of the housing and towards the lower grid 1800. Such a connection is made at each intersection of pipes 1910, 1950.

As shown in FIG. 7, the brackets 1100, 1300 are welded on the upper pipe 1850 of grid 1800 such that a portion of the pipe 1850 is seated within the aligned, upwardly extending notches 1112 The pair of brackets 1200, 1400 are welded on the lower pipe 1810 such that a portion of the pipe 1810 is seated within downwardly extending notches 1114. Upon the respective webs of each bracket forming a square, the upwardly extending bracket mounting flanges 1120 of the brackets 1100, 1200, 1300, 1400 are adjacent. Bolt/nut combinations 1125 are inserted through rear-aligned apertures in each flange 1120, through the brake plate 1150 and appropriately tightened. Upon tightening, the webs 1110, 1111 of brackets 1100, 1200, 1300, 1400 present a four-cornered housing surrounding a central open area 1500. The intersection of chords 1810, 1850 occurs within this central area 1500. It is understood that the welding of the pipes 1810, 1850 to the respective brackets may occur after the tightening of the bolt/nut combinations 1125 if so desired. As shown in FIG. 7, the mounting flanges 1120 of each bracket upwardly extend from each corner of the housing and towards the upper grid 1900. Also, round pipes may be substituted for the square pipes 1810, 1910 if desired.

Thus, it can be appreciated that the brackets 1100, 1200, 1300, 1400 upon reversal may be used with either grid 1800, 1900.

As previously discussed, various spatial relationships between the upper 1900 and lower 1800 grids may be utilized in a space frame system 2000. For purposes of illustration and not limitation the use of a square-on-square offset is discussed. Thus, the intersection of the pipes 1910, 1950 of the upper grid with accompanying connectors 2010 will be vertically displaced from the center of a square resulting from the intersection of the plurality pipes 1810, 1850 of the lower grid. Accordingly, it is desired to connect a diagonal chord 1990 between a central joint connector 2010 on the upper grid 1900 and a joint connector 2010 found at each corner of the underlying square of the lower grid 1800.

Figure 8:
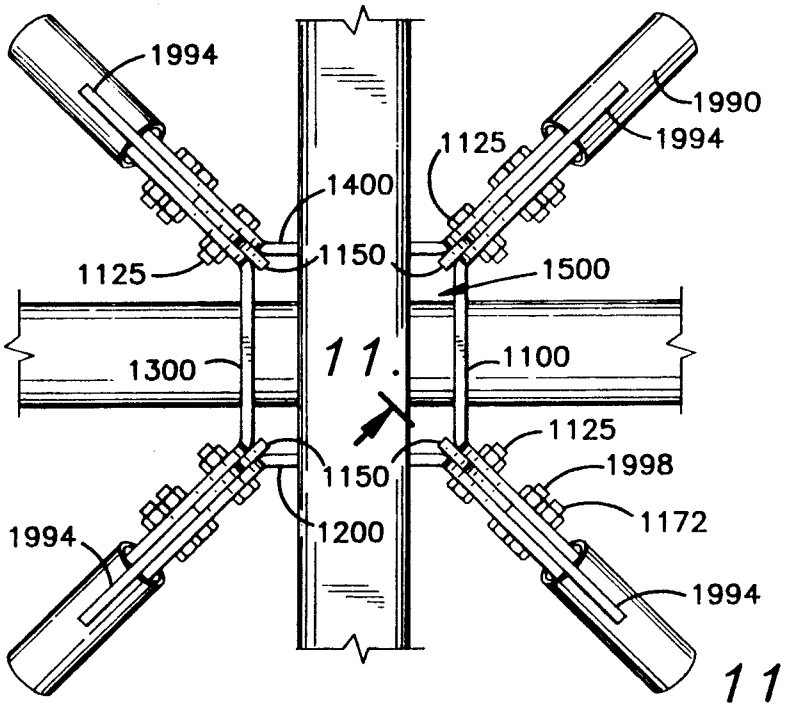
FIG. 8 is a top plan view, taken along lines 8—8 in FIG. 7, showing diagonal chords diagonally extending from such chord mounting flange.
Figure 11:
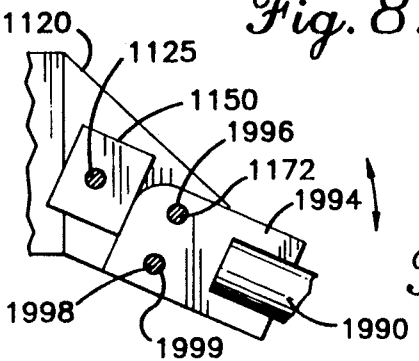
FIG. 11 is a fragmentary view, taken along lines 11—11 in FIG. 8, illustrating the relationship among the mounting flange chord mounting plate and brake plate.

FIG. 7 shows the connection of a diagonal chord 1990 from a corner of an upper grid 1900 joint connector 2010 to a corner of the lower grid 1800 joint connector 2010 as found at a corner of the underlying square. As shown, each chord 1990 connection is provided by cutting slots 1992 at the opposed end of each diagonal chord 1990 and welding a planar plate 1994 therein. A first upper aperture 1996 in each plate 1994 is aligned with the aperture 1997 in the adjacent chord mounting flange 1120. Bolt/nut combinations 1172 are extended through the flange apertures 1997 and plate 1994 apertures. This connection is done for each diagonal chord 1990 extending from each housing corner of the upper grid 1900. Upon such connection the chords 1990 are downwardly pivoted about bolts 1172. Upon the chords 1990 reaching a desired downward extension, the edge of the plate 1994 wall contacts plate 1150 if chord 1990 extends beyond a desired extension (FIG. 8). Such contact precludes further rotation of chord 1990. Subsequently, apertures 1978 in flanges 1120 are aligned with the aperture 1999 in the plate 1994 for insertion of bolt-/nut combinations 1998 therethrough.

Brake plate 1150 is configured such that it will contact the plate 1994 of each chord 1990 when the same extends beyond a desired angular extension relative to the connector 2010. Such plate also spaces apart mounting flanges 1120 to allow for insertion of mounting plate 1994 therebetween and subsequent tightening of the bolt/nut combinations 1996, 1998. Likewise the opposed ends of each chord 1990 present a planar plate 1994 which are likewise secured to mounting flanges 1120 upwardly extending from a corner on a lower connector 2010 found at each corner of the underlying square. Such connections are made throughout the entire space frame 2000. It is understood that not all joint connectors may have four diagonal chords 1990 extending therefrom, e.g. those connectors adjacent the perimeter of the frame system.

Electrical, mechanical, insulation and roofing may then be installed on the frame 2000 at this time. Upon completion the ground adjacent space frame system 2000 may be lifted into place by a crane or the like upon the vertical building support members.

The entire processes, e.g. as above described, may be done in the shop and/or at a ground-adjacent area. The configuration of the chord mounting flanges 150 or the flange 1120/plate 1150 combination and apertures therein are designed to provide feedback to the user that a desired angle of extension for the diagonal chord 990 or 1990 has been achieved. Thus, the user can be assured that the forces acting along the diagonal chords 990 or 1990 will pass through the center of the central area 500, 1500 of each respective housing. As such, the tension and compression forces may be directed to a single point during construction so as to keep the eccentric forces to a minimum but determinable value. Thus, my joint connectors 10 or 2010 result in a very rigid space frame 1000, 2000 which provides great rigidity to torsional forces resulting from non-symmetrical structures and loads.

Although one space frame arrangement has been described it is understood that my joint connectors 10, 2010 may be utilized in various space frame configurations with the same resulting effects and results.

It is to be understood that while certain forms of this invention have been illustrated and described, it is not limited thereto except insofar as such limitations are included in the following claims and allowable functional equivalents thereof.

Having thus described the invention what is claimed as new and desired to be secured by Letters Patent is as follows:

1. A joint connector for a space frame system comprising an upper grid and a lower grid with each grid including a plurality of transverse, support pipes and diagonal chord members connected between said grids, said connector comprising:

a first pair of spaced-apart brackets with each bracket comprising:
- a web having first and second ends;
- a mounting flange located at each end of said web;
- a seat in said web for welding a portion of a first pipe of a grid therein;

a second pair of spaced-apart brackets with each bracket comprising:
- a web having first and second ends;
- a chord mounting flange located at each end of said web, said chord mounting flange having a bracket mounting section and a chord mounting section;
- a seat in said web for welding a portion of a second pipe of the grid therein, the second pipe transversing the first pipe seated in the first pair of spaced-apart brackets;
- means for attaching each mounting flange of each bracket of said first pair of brackets to each adjacent bracket mounting section of said second pair of brackets, said attachment presenting a housing with an intersection of said first and second pipes being located therein, the chord mounting section presenting a flange for attachment of a diagonal chord thereto.

2. The device as claimed in claim 1 wherein said housing is generally quadrangular in configuration with a chord mounting section at each corner for attachment of a diagonal chord end thereto.

3. The device as claimed in claim 2 wherein each chord mounting section is canted relative to said housing.

4. The device as claimed in claim 3 wherein each canted chord mounting section is directed to a central point within the housing.

5. The device as claimed in claim 1 further comprising means for connecting one end of a diagonal chord to said chord mounting section, the chord mounting section directing the chord to a desired location away from the connector.

6. The device as claimed in claim 5 wherein said connecting means comprises;

a plate;

means for attaching said plate to an end of the diagonal chord;

fastener means for securing said plate to said chord mounting section.

7. The device as claimed in claim 6 wherein said attaching means comprises:

a slot at the end of said diagonal chord for insertion of said plate therein, the plate being welded to the slot.

8. The device as claimed in claim 6 wherein said fastener means comprises:

a plurality of apertures in said chord mounting section;

a plurality of apertures in said plate;

means extending through the aligned apertures in said chord mounting section and said plate for securing one to the other.

9. The device as claimed in claim 2 further comprising a second joint connector, the connector secured to first and second transverse pipes in the other of said upper and lower grids, the chord mounting sections of each connector extending in a direction towards the other of said upper and lower grids to facilitate the connection of an opposite end of the diagonal chord thereto.

10. A connector for a space frame system comprising an upper grid of transverse chords and a lower grid of transverse chords with diagonal chords spanning therebetween, the connector comprising:

a housing presenting four corners as formed by a first pair of opposed webs and a second pair of opposed webs generally normal to said first pair of webs;

a first seat in each first pair of opposed webs for receiving a chord of a grid of the space frame therein;

a second seat in each second pair of opposed webs for receiving a transverse chord of the grid of the space frame therein, the chord in said second seat generally intersecting the chord in said first seat in a relative displacement therebetween, the intersection of the chords being positioned within said housing;

a chord mounting flange extending from each corner of the housing and extending in a direction towards the other of said upper and lower grids;

means for releasably connecting an end of a diagonal chord to one of said chord mounting flanges, the chord mounting flange directing the connected diagonal chord to a connector in the other of said upper and lower grids.

11. The device as claimed in claim 10 further comprising:

a mounting flange extending from first and second ends of each web of said first pair of opposed webs;

said chord mounting flange extending from first and second ends of each web of said second pair of opposed webs;

means for attaching each mounting flange to each adjacent chord mounting flange in a manner to present said housing.

12. The device as claimed in claim 11 wherein said attaching means comprises:

releasable fastener means extending through said mounting flange and adjacent chord mounting flange for securing one to the other.

13. The device as claimed in claim 10 wherein each chord mounting flange includes a section canted relative to said housing in a direction towards the other of said grids upon said attachment.

14. The device as claimed in claim 13 wherein said connecting means comprises:

a plate:

means for fixing said plate to an end of one of the diagonal chords;

fastener means for securing said plate to said chord mounting section.

15. The device as claimed in claim 10 wherein each seat in each pair of webs comprises a notch for receiving the respective chord therein.

16. The device as claimed in claim 15 wherein the notch in said first pair of webs is in a direction opposite the notch in said second pair of webs to facilitate the respective seating of the transverse chords therein.

17. A joint connector for a space frame system comprising an upper grid and a lower grid with each grid including a plurality of transverse, support pipes and diagonal chord members connected between said grids, said connector comprising:

a first pair of spaced-apart brackets with each bracket comprising:

a web having first and second ends;

a mounting flange located at each end of said web;

a seat in said web for welding a portion of a first pipe of a grid therein;

a second pair of spaced-apart brackets with each bracket comprising:

a web having first and second ends;

a mounting flange located at each end of said web;

a seat in said web for welding a portion of a second pipe of the grid therein, the second pipe transversing the first pipe seated in the first pair of spaced-apart brackets;

a brake plate positioned between each mounting flange;

means for attaching each mounting flange of each bracket of said first pair of brackets to each adjacent bracket mounting flange of said second pair of brackets with said brake plate positioned therebetween, said plate displacing said mounting flanges one from the other for extension of a portion of a diagonal chord end therebetween, said brake plate precluding extension of the diagonal chord beyond a desired angular extension relative to said mounting flanges.

18. The device as claimed in claim 17 wherein said attached mounting flanges present a housing generally quadrangular in configuration with said attached mounting flanges extending from each corner for attachment of a diagonal chord end thereto.

19. The device as claimed in claim 17 further comprising means for connecting one end of a diagonal chord between said mounting flanges, the chord mounting flanges directing the chord to a desired location away from the connector.

20. The device as claimed in claim 19 wherein said connecting means comprises;

an end plate;

means for attaching said plate to an end of the diagonal chord;

said attaching means releasably securing said end plate to said mounting flange.

21. The device as claimed in claim 20 wherein said end plate at the end of said diagonal chord contacts said brake plate positioned between said mounting flanges upon said diagonal chord reaching a desired location, said plate chord delimiting movement of said chord away from said desired location.

22. The device as claimed in claim 17 further comprising a second joint connector, the connector secured to first and second transverse pipes in the other of said upper and lower grids, the chord mounting flanges of each connector extending in a direction towards the other grid to facilitate the connection of an opposite end of the diagonal chord thereto.

* * * * *